US008531257B2

(12) United States Patent
Vuillermet et al.

(10) Patent No.: US 8,531,257 B2
(45) Date of Patent: Sep. 10, 2013

(54) CONTACTOR AND SWITCH

(75) Inventors: Yannick Vuillermet, Chambery (FR); Henri Sibuet, La Buisse (FR)

(73) Assignee: Commissariat a l'Energie Atomique et aux Energies Alternatives, Paris (FR)

( * ) Notice: Subject to any disclaimer, the term of this patent is extended or adjusted under 35 U.S.C. 154(b) by 11 days.

(21) Appl. No.: 13/347,821

(22) Filed: Jan. 11, 2012

(65) Prior Publication Data

US 2012/0182100 A1 Jul. 19, 2012

(30) Foreign Application Priority Data

Jan. 19, 2011 (FR) ..... 11 50424

(51) Int. Cl.
*H01H 51/22* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS

| | | | | |
|---|---|---|---|---|
| 5,072,288 | A * | 12/1991 | MacDonald et al. | 257/420 |
| 5,883,556 | A | 3/1999 | Shutes | |
| 6,040,748 | A | 3/2000 | Gueissaz | |
| 6,211,598 | B1 * | 4/2001 | Dhuler et al. | 310/307 |
| 6,587,021 | B1 * | 7/2003 | Streeter | 333/262 |
| 6,621,390 | B2 * | 9/2003 | Song et al. | 335/78 |
| 6,624,730 | B2 * | 9/2003 | Johnson et al. | 335/78 |
| 7,138,893 | B2 * | 11/2006 | Nakanishi et al. | 335/78 |
| 7,215,229 | B2 * | 5/2007 | Shen et al. | 335/78 |
| 2009/0189720 | A1 | 7/2009 | Debarnot et al. | |
| 2009/0237188 | A1 | 9/2009 | Christenson | |

FOREIGN PATENT DOCUMENTS

| | | |
|---|---|---|
| JP | 3241620 | 10/1991 |
| JP | 2003031094 | 1/2003 |
| JP | 2008243450 | 10/2008 |
| WO | WO 01/67476 | 9/2001 |
| WO | WO 02/39472 | 5/2002 |

* cited by examiner

*Primary Examiner* — Bernard Rojas
(74) *Attorney, Agent, or Firm* — Occhiuti Rohlicek & Tsao LLP

(57) ABSTRACT

A magnetically actuatable contactor has first and second magnetic material strips extending longitudinally. Each has a pad with a contact face parallel to the longitudinal direction. The pads face each other when an intersection of the one contact face and a projection in a transversal direction of the other contact face forms an overlap zone having a surface area. A pad is capable of being transversally shifted in response to a magnetic field between closed and opened positions. In closed position and open positions, the faces and respectively in contact and separated. At least one strip forms pairs of facing pads disposed consecutively along the longitudinal direction. A bridge links two consecutive pads. A cross-section of the bridge is reduced relative to a cross-section of the pads and a surface area of a smallest cross-section of the bridge.

11 Claims, 3 Drawing Sheets

CONTACTOR AND SWITCH

CROSS REFERENCE TO RELATED APPLICATIONS

This application claims the benefit of the Jan. 19, 2011 priority date of French Application No. 1150424. The contents of the foregoing application is incorporated herein by reference.

BACKGROUND OF THE INVENTION

The invention pertains to a contactor actuatable by a magnetic field as well as to a switch comprising this contactor.

Contactors that can be actuated by a magnetic field are also called Reed switches.

Prior-art contactors comprise at least one first strip and one second strip made out of magnetic material extending along a longitudinal direction:

the first strip comprising at least one pad having a contact face $F_{1i}$, the second strip having at least one pad $P_{2i}$ facing the pad $P_{1i}$ and having a contact face $F_{2i}$, the pads $P_{1i}$ and $P_{2i}$ facing each other when the intersection of the face $F_{2i}$ and of the projection in a transversal direction, perpendicular to the longitudinal direction, of the face $F_{1i}$ on the face $F_{2i}$ forms an overlap zone $Z_i$, the surface area $S_{zi}$ of which is strictly greater than zero, at least one pad of each pair of pads $P_{1i}$, $P_{2i}$ facing each other being capable of being shifted along the transversal direction, under the effect of the magnetic field, between:

a closed position in which the faces $F_{1i}$ and $F_{2i}$ are directly in mechanical contact with each other to enable the passage of a current, and an open position in which the faces $F_{1i}$ and $F_{2i}$ are separated from each other by an air gap so as to be electrically insulated from each other.

When at least one of the pads is in the closed position, the contactor is said to be in the closed position. The contactor is in the open position when all the pads are in the open position.

SUMMARY OF THE INVENTION

The invention is aimed at reducing the resistance of this contactor in the closed position. An object of the invention is a contactor in which:

the first and second strips comprise pads forming several pairs of pads $P_{1i}$, $P_{2i}$ facing each other, immediately consecutive along the longitudinal direction, and each strip comprises at least one bridge $Pt_{ji}$, each bridge mechanically and directly linking two pads $P_{ji}$, $P_{j,i+1}$ that are immediately consecutive in the same strip, the cross-section of this bridge $Pt_{ji}$ being reduced as compared with the cross-section of the pads $P_{ji}$ et $P_{j,i+1}$, and the surface area $S_{Ptji}$ of the smallest cross-section of the bridge $Pt_{ji}$ verifying the following relationship: $0<S_{Ptji}<\frac{2}{3}S_{Zi}$, where j is an index identifying the strip and i is an index identifying the pad of this strip.

The above contactor has a resistance in the closed position that is smaller than that of an identical reference contactor which however is provided with only one pair of pads. Indeed, since the cross-section of the bridges $Pt_{ji}$ is smaller than the surface area $S_{Zi}$ of the overlap zone (i.e. since the surface area $S_{Ptji}$ is smaller than two-thirds of the surface area $S_{Zi}$), the majority of the magnetic flux concentrated by the pad $P_{1i}$ crosses the overlap zone rather than the bridge $Pt_{1i}$. The pads of each pair of pads $P_{1i}$, $P_{2i}$ are therefore drawn to each other under the effect of the magnetic field by a force close to that observed for the reference contactor. The resistance $R_i$ between the pads of each pair of pads $P_{1i}$, $P_{2i}$ in the closed position is therefore fairly close to that observed for the reference contactor. However, the above contactor has n pairs of pads $P_{1i}$, $P_{2i}$ and therefore n parallel-connected resistors $R_i$ when the switch is in the closed position. The resistance in the closed position of the above contactor is therefore far smaller than that of the reference contactor because of this parallel-mounting of several resistors $R_i$.

In fact, the resistance of the above contactor in the closed position is close to that which would be obtained by the parallel connection of n reference contactors. However, as compared with this parallel connection of n reference contactors, the above contactor has a far smaller space requirement. Indeed, the bridges $Pt_{ji}$ mechanically and electrically connect the different pads to one another. It is therefore not necessary to provide for specific electrical tracks to set up the parallel connection of the pairs of pads as would be the case if n reference contactors were to be parallel connected. Furthermore, the space requirement of the above contactor is reduced. More specifically, the greater the number n of pairs of pads, the greater the overlap between the first and second strips. Thus, it has been estimated that the space requirement of the above contactor is smaller than nS/2 where S is the space requirement of the reference contactor while the space requirement of n parallel-connected reference contactors is substantially equal to nS. The space requirement of the contactor is represented by the surface area that it occupies in a plane parallel to the longitudinal and transversal directions.

The embodiments of this contactor may have one or more of the following characteristics:

the surface area $S_{Zi}$ of each overlap zone verifies the following two relationships: $0<S_{zi}\leqq S_{1i}/3$ and $0<S_{zi}\leqq S_{2i}\leqq/3$, where $S_{ij}$ is the surface area of the contact face $F_{ij}$;

each pad $P_{ji}$ is a parallelepiped extending in parallel to the longitudinal direction, with a thickness $e_{pji}$ in the transversal direction and the overlap zone is a rectangle with a length x in the longitudinal direction, the length x being equal to $e_{pji}/2$ plus or minus 30%, at least one of the pads $P_{ji}$ faces the pads $P_{2i}$ and the pad $P_{2,i+1}$;

the surface areas $S_{Zi}$ of the overlap zones are all equal and the dimensions of the pads $P_{ij}$ are also all equal to one another;

the contactor has a plane substrate within which there is hollowed out a well and the strips are entirely received within this well;

each bridge $Pt_{ji}$ corresponds to the bottom of a groove whose opening is pointed towards the air gap.

These embodiments of the contactor furthermore have the following advantages:

having a smaller overlap zone than the surface area $S_{1i}$ or $S_{2i}$ of the pad concentrates a magnetic flux in this overlap zone, thus increasing the contact force in the closed position and consequently diminishing the resistance of the contactor in the closed position;

choosing a length x for the overlap zone close to half the thickness $e_{pji}$ maximizes the contact force while at the same time minimizing the space requirement of the contactor;

having a pad $P_{1i}$ facing the pads $P_{2i}$ and the pad $P_{2,i+1}$ increases the number of contactors in the closed position and therefore further diminishes the resistance of the contactor in the closed position;

sizing the different pads and their position to obtain substantially equal contact forces between each pair of pads diminishes the resistance of the contactor in the closed position while at the same time limiting the increase of its space requirement;

housing the strips entirely within a well facilitates the making of a hood insulating this well from the external environment.

An object of the invention is also a switch comprising:

the above contactor, and a source of induction $B_0$ parallel to the longitudinal direction under the effect of which the pads shift from their open position to their closed position, wherein the dimensions of the pads are such that the intensity of the magnetic induction $B_0$ makes it possible to saturate these pads $P_{1i}$ and $P_{2i}$ while a magnetic induction $B_1$, which is identical to the induction $B_0$ except that its intensity is equal to 80% of the intensity of the induction $B_0$, does not enable these pads $P_{1i}$ and $P_{2i}$ to be saturated.

Sizing the pads $P_{ji}$ so that they are just saturated by the field $B_0$ limits the space requirement of the contactor and therefore that of the switch to the maximum degree.

BRIEF DESCRIPTION OF THE DRAWINGS

The invention will be understood more clearly from the following description given purely by way of a non-exhaustive example and made with reference to the appended drawings, of which.

In these Figures, the same references are used to designate the same elements.

DETAILED DESCRIPTION OF THE INVENTION

Here below in this description, the characteristics and functions well known to those skilled in the art are not described in detail.

Figure 1:
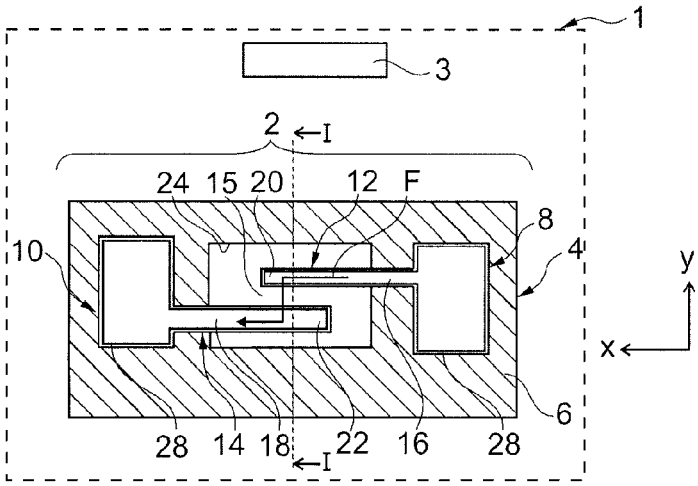
FIG. 1 is a schematic illustration of a switch equipped with a contactor actuatable by a magnetic field.

FIG. 1 shows a switch 1 equipped with:

a micro-contactor 2 actuatable by a magnetic field, and a controllable magnetic-field source 3.

The source 3, when activated, generates a magnetic field or a magnetic induction $B_0$ parallel to a longitudinal direction X. When there is no command, the source 3 generates no magnetic field.

The micro-contactor 2 is a contactor. However, it differs from macroscopic contactors inter alia by its method of fabrication. The micro-contactors are made by using the same batch manufacturing methods as those used to make microelectronic chips. For example, the micro-contactors are made out of a monocrystalline silicon or glass machined by photolithography and etching and/or structured by epitaxial growth and deposition of metallic material.

This micro-contactor 2 is made in a plane substrate 4 that extends horizontally, i.e. in parallel to the orthogonal directions X and Y. Here below in this description, the vertical direction, orthogonal to the directions X and Y, is denoted as Z.

The substrate 4 is a rigid substrate. To this end, its thickness in the direction Z is greater than 200 μm and preferably greater than 500 μm. It is advantageously an electrically insulating substrate.

For example, here, this substrate 4 is a silicon substrate, i.e. a substrate comprising at least 10% and typically more than 50% by mass of silicon. This substrate is inorganic and non-photosensitive. The substrate 4 has a horizontal plane upper face 6.

The micro-contactor 2 has electrodes 8 and 10 through which there flows the current that passes through this micro-contactor. These electrodes 8 and 10 are fixed without any degree of freedom to the substrate 4. Here, these electrodes 8 and 10 are parallelepipeds whose upper faces are situated in the same plane as the upper face 6. The vertical faces of these electrodes extend into the substrate 4. The vertical faces are connected to one another within the substrate by a lower face, for example parallel to the upper face.

Strips 12, 14 extend in parallel to the direction X starting from the electrodes, respectively 8 and 10. These strips 12, 14 can be shifted relatively to each other, under the effect of a magnetic field parallel to this direction X, between:

an open position (shown in FIG. 1) in which the strips are electrically insulated from each other by an air gap 15 filled with a dielectric gas, and a closed position in which the strips are directly mechanically in contact with each other to enable the passage of the current between the electrodes 8 and 10.

Here, each strip has the shape of a parallelepiped that extends in parallel to the direction X. Thus, like the electrodes, each strip has:

an upper face situated on the same plane as the upper face 6 of the substrate 4, vertical faces which penetrate into the interior of the substrate 4, and a lower face situated beneath the face 6 of the substrate 4, and, for example, parallel to the upper face of this strip.

Each strip 12, 14 has a proximal end, respectively 16, 18 mechanically and electrically connected respectively to the electrodes 8 and 10. Here, the proximal ends 16 and 18 are connected without any degree of freedom to their respective electrodes. Thus, these proximal ends 16, 18 are immobile.

In this embodiment, the strips form one and the same block of material with the electrode to which they are mechanically connected.

Each strip 12, 14 also has a distal end respectively 20, 22. These distal ends 20 and 22 face each other and are separated from each other by the air gap 15 in the open position. The thickness of the air gap in the direction Y is denoted as d. Conversely, these distal ends are directly supported on each other in the closed position.

Here, in this embodiment, both distal ends 20, 22 are flexible so as to shift between the open and closed positions.

The distal ends 20, 22 move solely in parallel to the horizontal plane X, Y. To this end, they are received within a well 24 filled with a dielectric gas such as air or the like. More specifically, each distal end 20, 22 bends in order to reach the closed position from the open position. The deformations undergone by each distal end 20, 22 between the closed and open positions are all elastic to enable it to return automatically to the open position when there is no external force applied.

To be flexible, each distal end 20, 22 is far longer in the direction X than it is thick in the direction Y. For example, each distal end 20, 22 is five, ten or fifty times longer than it is thick. Here, the thickness of each distal end 20, 22 is smaller than 100 μm and preferably smaller than 50 or 10 μm.

The height $e_c$ of each distal end 20, 22 in the direction Z is typically, in this example, of the order of 20 to 50 μm.

Here, the distal ends 20, 22 are formed to limit the resistance of the micro-contactor in the closed position. One example of such forming is described with reference to FIG. 3.

The essential part of the strips 12, 14 and of the electrodes 8, 10 is made out of soft magnetic material. A soft magnetic material is a material having a relative permeability for which the real part at low frequency is greater than 1,000. Such a material typically has a coercive excitation in order to be demagnetized that is below 100 $A \cdot m^{-1}$. For example, the soft magnetic material used here is an alloy of iron and nickel.

To increase the electrical conductivity of the strips, the vertical and lower faces of these strips are covered with a conductive coating 28. This is also the case for the vertical and lower faces of the electrodes 8, 10. For example, this coating is made out of rhodium (Ro) or ruthenium (Ru) or platinum (Pt). The micro-contactor 2 can also comprise a hood 30 (FIG. 2) that covers the well 24. To simplify FIG. 1, this hood is not shown therein.

Figure 2:
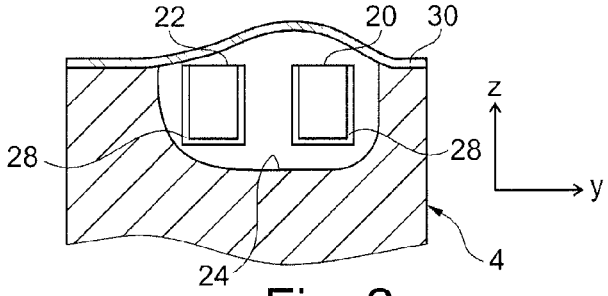
FIG. 2 is a schematic illustration in partial cross-section of the contactor of FIG. 1.

FIG. 2 shows the micro-contactor 2 in a vertical section along a section plane I-I shown in FIG. 1. In this FIG. 2, the hood 30 which covers the well 24 is shown. This hood 30 prevents impurities from penetrating into the interior of the well 24 and hampers the shifting of the strips 12, 14. It also prevents the oxidation of the contact.

When an external magnetic field is applied in parallel to the direction X, it is concentrated and guided by the strips 12 and 14. The field lines of this magnetic field are symbolized by an arrow F in FIG. 1. This creates forces in the air gap 15 which tend to reduce this air gap. These forces cause each distal end 20, 22 to bend until they come into contact with each other. Thus, an external magnetic field makes it possible to shift the strips 12, 14 between the open position and the closed position. When the external magnetic field disappears, the distal ends 20, 22 return to the open position in the manner of a spring leaf, i.e. by elastic deformation.

Figure 3:
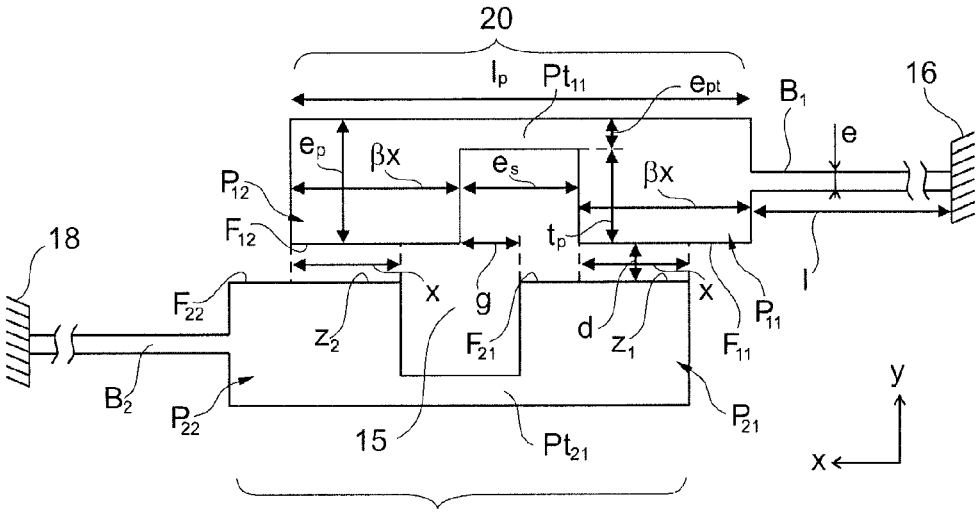
FIG. 3 is a schematic illustration of the conformation of the ends of strips of the contactor of FIG. 1.
Figure 6:
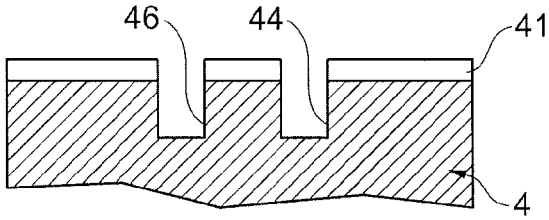

FIG. 3 gives a more detailed view of the forming of the ends 20 and 22 implemented to reduce the resistance of the micro-contactor 2 in the closed position. Here, each end 20, 22 has several pads $P_{ji}$ positioned beside one another in the direction X, where the index j identifies a strip and the index i identifies the pad of this strip. More specifically, here below in this description, the index j takes the value "1" to designate the strip 12 and the value "2" to designate the strip 14.

Two pads $P_{ji}$ and $P_{j,i+1}$ immediately consecutive in the direction X are mechanically connected to each other by means of a bridge $Pt_{ji}$.

Each pad $P_{ji}$ has a plane face $F_{ji}$ pointing toward the air gap 15. Here, each pad $P_{1i}$ faces a pad $P_{2i}$ of the other strip. Two pads $P_{1i}$ and $P_{2i}$ are placed so as to be facing each other if the intersection of the face $F_{2i}$ and the projection, in the direction Y, of the face $F_{1i}$ on the face $F_{2i}$ forms an overlap zone $Z_i$ whose surface area $S_{Zi}$ is strictly greater than zero. Here below in this description, two pads $P_{1i}$ and $P_{2i}$ facing each other have the same index i.

The surface area $S_{Pji}$ of the cross section of the bridge $Pt_{ji}$ is strictly smaller than the surface area of the cross section of the pads $P_{ji}$ and $P_{i,j+1}$ that it connects. Here, the term "surface area of the cross section" designates the surface area of the section of the pad or of the bridge parallel to the plane defined by the directions YZ.

Here, the forming of the ends 20 and 22 is represented in the particular case where the number n of pairs of pads $P_{1i}$, $P_{2i}$ facing each other is equal to two.

Furthermore, here, the ends 20 and 22 are identical except that they are pointed towards each other. Indeed, the faces $F_{1i}$ are pointed to the faces $F_{2i}$. Thus, here below, only the end 20 is described in detail.

The pad $P_{11}$ is directly connected to the end 16 by a parallelepiped arm $B_1$ with a length l in the direction X, a thickness e in the direction Y and a height $e_c$ in the direction Z. The pad $P_{11}$ is connected to the pad $P_{12}$ by the bridge $Pt_{11}$. In this particular embodiment, the dimensions of the pads $P_{11}$ and $P_{12}$ are identical. Thus here below, only the dimensions of the pad $P_{11}$ are described in greater detail.

The pad $P_{11}$ is a parallelepiped with a length βx, a thickness $e_p$ and a height $e_c$. The face $F_{11}$ and the overlap zone $Z_1$ are therefore rectangles. The length of the overlap zone $Z_1$ in the direction X is denoted as "x". Here, the length of the pad $P_{11}$ is taken to be proportional to the length x of the overlap zone $Z_1$. It is therefore noted in the form of a product: a constant β multiplied by the length x.

The bridge $Pt_{11}$ is a parallelepiped with a length $e_s$, a thickness $e_{pt}$ and a height $e_c$. The bridge $Pt_{11}$ is sized so its transversal surface area $S_{Pt11}$ is at least smaller than two-thirds of the surface area $S_{Z1}$ of the overlap zone $Z_1$. When the surface area $S_{Pt11}$ is smaller than two-thirds of the surface area $S_{Z1}$ or $S_{Z2}$, the greater part of the magnetic flux concentrated by the pads $P_{11}$ or $P_{12}$ passes through the air gap 15 rather than through the bridge $Pt_{11}$. This therefore increases the quantity of magnetic flux that passes through the air gap 15 by means of the overlap zones. Now, the contact force $f_{contact}$ between the pairs of pads facing each other is proportional to the magnetic flux divided by the surface area crossed by this flux. Thus, minimizing the vertical section of the bridges $Pt_{1i}$ increases the force of contact between the pads in the closed position and therefore reduces the resistance of the contactor in the closed position.

Here, the thickness $e_{pt}$ of this bridge $Pt_{11}$ is at least smaller than one third of the thickness $e_p$ of the pads $P_{11}$ and $P_{12}$. Thus, this bridge $Pt_{11}$ also corresponds to the bottom of a groove with a depth $t_p$ between the faces $F_{11}$ and $F_{12}$. The width of this groove is equal here to the length $e_s$ of the bridge $Pt_{11}$.

It will be noted that the thickness $e_p$ of the pad $P_{11}$ is equal to the sum of the depth $t_p$ and the width $e_{pt}$ of the bridge $Pt_{11}$.

The total length of the end 20 is denoted as $l_p$. Here, the length $l_p$ is equal to $2\beta x+e_s$.

The ends 20 and 22 are offset relatively to each other in the direction X by a distance g to reduce the overlapping surfaces $S_{Zi}$. In this embodiment, the distance g is chosen so that the following two relationships are verified:

$$S_{Z1} \leqq S_{1i}/3$$

$$S_{Z2} \leqq S_{2i}/3,$$

where $S_{1i}$ and $S_{2i}$ are the surface areas respectively of the faces $F_{1i}$ and $F_{2i}$.

In order to simplify the figures, the representations of the ends 20, 22 are not drawn to scale, and these two relationships are not shown.

Preferably, the surface area $S_{Zi}$ is smaller than a quarter or one eighth of the surface areas $S_{1i}$ and $S_{2i}$.

Reducing the overlap surface $S_{Zi}$ concentrates the magnetic flux on a smaller surface area than the surface area of the faces $F_{ji}$. This therefore increases the contact force $f_{contact}$ between these pads and thus reduces the resistance of the contactor in the closed position.

The sizing of the ends 20 and 22 shall now be described with reference to the method of FIG. 4.

Here, the sizing of the ends 20 and 22 is illustrated by numerical examples given for the following condition:

the intensity of the magnetic field $B_0$ produced by the source 3 to shift the micro-contactor 2 towards its closed position is 50 mT, the voltage that must be switched by the micro-contactor 2 is at most 50 volts, the contact force $f_{contact}$ exerted between each pair of pads and the closed position is 150 μN, the restoring force $f_{rappel}$ which brings the pads back to their open position is 20 μN per contact, the restoring force $f_{amin}$ exerted by the bridge $Pt_{11}$ to bring the pad $P_{12}$ back towards its open position is 20 μN, the relative permeability of the magnetic material used to make the strips 20 and 22 is 1000, the Young's modulus E of the magnetic material is equal to $1.85.10^{11}$ Pa, and the polarization $J_s$ of the magnetic material at saturation is equal to 1 T.

The contact force $f_{contact}$ is the force exerted by the pad $P_{1i}$ on the pad $P_{2i}$ in the closed position. The greater this contact force, the greater is the reduction of the resistance of the contact.

The restoring force $f_{rappel}$ is a restoring force exerted on each pad, and permanently pulls them toward the open position.

The polarization $J_s$ is the polarization of the magnetic material observed when it is saturated. As a first approximation, the polarization is the ratio between the intensity of the magnetic field $B_0$ and the demagnetization factor Nd.

At a step 27, the distance d of the air gap in the open position is chosen. This distance d must be great enough to electrically insulate the pads $P_{1i}$ from the pads $P_{2i}$ in the open position. It therefore depends especially on the voltage present between the terminals 8 and 10 of the micro-contactor 2 in the open position. Here, this distance d is chosen to be greater than 5 μm so as to electrically insulate the pads $P_{1i}$ from the pads $P_{2i}$ even when there is a voltage of 220 volts between the pads 8 and 10. This value of 5 μm is given in the special case where the air gap 15 is filled with air. Indeed, the disruptive field of air is of the order of 50V/μm for dimensions as small as those of the ends 20 and 22.

Besides, the distance d is chosen to be small enough to remain within the zone of elastic deformation of the strips 12 and 14. The maximum limit for the distance d therefore depends on the characteristics of the magnetic material chosen such as its Young's modulus E. Here, to remain within this zone of elastic deformation, d is chosen to be smaller than 15 μm.

In this example, the distance d is fixed to be equal to 5 μm to minimize the space requirement of the micro-contactor 2.

At a step 29, the height $e_c$ is fixed. The greater this height $e_c$ the greater the decrease in the resistance of the micro-contactor 2 in the closed position. However, technological constraints of manufacture dictate an upper limit on the height $e_c$. Thus, here, the height $e_c$ is chosen to be to most equal to 30 μm and at least equal to 10 μm. For numerical applications, the height $e_c$ is chosen to be equal to 20 μm.

At a step 31, the thickness $e_p$ of the pads is calculated so as to obtain a magnetic force $f_f$ which draws the pad $P_{1i}$ to the pad $P_{2i}$ in the presence of the magnetic field $B_0$ equal to 170 μN. This force $f_f$ counters the restoring force $f_{rappel}$ and the force $f_{amin}$ which are taken here to be equal to 20 μN. More specifically, the forces $f_{contact}$, $f_f$ and $f_{rappel}$ are connected to one another by the following relationship: $f_{contact}=f_f-f_{rappel}$.

Thus, to obtain a contact force $f_{contact}$ of 150 μN, the force $f_f$ is taken here to be equal to 170 μN.

To calculate the thickness $e_p$, different numerical simulations using software programs have been made to experimentally establish a relationship linking the force $f_f$ to the thickness $e_p$. The relationship established is the following:

$$f_f = (3,4e_p + 25)\frac{e_c}{20} \tag{1}$$

In this relationship (1) the thickness $e_p$, the height $e_c$ are expressed in μm and the force $f_f$ is expressed in μN.

This relationship (1) has been established with the following assumptions:

the pads $P_{ji}$ are saturated by the magnetic field $B_0$, the presence of the bridges $Pt_{ij}$ and of the arms $B_j$ has been overlooked, and the thickness $e_p$ is assumed to range from 10 to 100 μm.

Furthermore, the relationship (1) has been established on the assumption that the length x of the overlap zone $Z_i$ is equal to half of the thickness $e_p$. In other words, the following relationship is verified:

$$x=e_p/2 \tag{2}$$

By means of this relationship (1), we obtain here the value of 40 μm for the thickness $e_p$.

At a step 32, the length x is calculated by means of the relationship (2). The length x is therefore equal here to 20 μm.

At a step 33, the length βx of the pads $P_{ji}$ is calculated. This length βx is determined so that each pad $P_{ji}$ is completely saturated magnetically when the field $B_0$ is present. Here, the length βx is calculated so that each pad $P_{ji}$ is just saturated. The term "just saturated" designates to the fact that each pad is saturated by the field $B_0$ and is not saturated by a field $B_1$ which is identical to the field $B_0$ except that its intensity is equal to 80% and, preferably, 90% of the intensity of the field $B_0$. To this end, different relationships obtained by modeling the pad $P_{ji}$ by means of the laws of electromagnetism are used.

More specifically, the following relationship linking the polarization $J_s$ of the material at saturation to the field $B_0$ is used:

$$J_s = \frac{B_0}{\frac{1}{\mu_r - 1} + Nd} \approx \frac{B_0}{Nd} \tag{3}$$

In this relationship (3) Nd is the factor of demagnetization of the pad $P_{ji}$. This factor Nd is a function of the dimensions of the pad $P_{ji}$. The following relationship which links the factor Nd to the dimensions of the pad is used:

$$Nd = \frac{e_c e_p}{(\beta x)^2}\left(\ln\left(\frac{4(\beta x)}{e_c + e_p}\right) - 1\right) \tag{4}$$

This relationship was obtained in assuming that the relationship relating the demagnetization factor Nd to the dimensions, established in the case of an ellipsoid, can also be applied in the case of a parallelepiped.

Thus, to obtain the value of the constant β, the following equation must be resolved:

$$\frac{B_0}{J_s} = \frac{e_c e_p}{(\beta x)^2}\left(\ln\left(\frac{4(\beta x)}{e_c + e_p}\right) - 1\right) \quad (5)$$

The resolution of this equation gives the value "7" for the constant β. Thus the length of the pad $P_{ji}$ here is 140 μm.

Then, at the step 34, the length l, the thickness e, the width $e_s$ and the depth $t_p$ are determined to obtain a restoring force $f_{rappel}$ equal to 20 μN and a force $f_{amin}$ equal to 20 μN. Here, for this purpose, e is fixed so as to minimize the space requirement of the micro-contactor 2. For example, e is chosen to be equal to 5 μm.

The distance g is also fixed in this particular case so that the pad $P_{1i}$ is facing only one pad $P_{2i}$. For example, g is chosen to be equal to 50 μm. Once the distance g has been fixed, the width $e_s$ and the total length $l_p$ of the end 20 are given by the following relationships:

$$e_s = g + \beta x - x, \quad (6)$$

$$l_p = 2\beta x + e_s \quad (7)$$

The force $f_{amin}$ is given by the following relationship:

$$f_{amin} = \frac{2\Gamma_{amin}}{e_s + \beta x} \quad (8)$$

$\Gamma_{amin}$ is the mechanical restoring torque exerted by the bridge $Pt_{11}$ on the pad $P_{12}$.

The torque $\Gamma_{amin}$ is given by the following relationship:

$$\Gamma_{amin} = S_{amin}\frac{d}{2}(e_s + \beta x) \quad (9)$$

The value $S_{amin}$ is itself given by the following relationship:

$$S_{amin} = \frac{E}{\frac{e_s^3}{3I_3} + \frac{(\beta x)^3}{3I_4} + \frac{1}{I_3}((\beta x)^2 e_s + (\beta x)(e_s)^2)} \quad (10)$$

The coefficients $I_3$ and $I_4$ are given by the following relationships:

$$I_3 = \frac{e_C \cdot (e_p - t_p)^3}{12} \quad (11)$$

$$I_4 = \frac{e_c \cdot e_p{}^3}{12} \quad (12)$$

Thus, the constraint set on the force $f_{admin}$ in enables the depth $t_p$ to be calculated from the preceding relationships.

Imposing the force $f_{amin} \geqq 20$ μN ensures that, if the pad $P_{11}$ returns to its position under the action of the restoring force $f_{rappel}$, the pad $P_{12}$ will do the same because the bridge $Pt_{11}$ is rigid enough for this purpose.

Once the depth $t_p$ has been calculated, the length l is calculated, enabling verification of the constraint according to which the force $f_{rappel}$ is equal to 20 μN. The force $f_{rappel}$ is given by the following relationship:

$$f_{rappel} = \frac{\Gamma_r}{21 + l_p + (\beta - 1)x} \quad (13)$$

$\Gamma_r$ is the torque of the restoring force. This torque is equal to twice the restoring torque $\Gamma_{meca}$ exerted by each of the strips 12 and 14. Thus, the restoring torque $\Gamma_r$ is defined by the following relationship:

$$2\Gamma_{meca} = \Gamma_r \quad (14)$$

The torque $\Gamma_{meca}$ of a single strip is defined by the following relationship:

$$\Gamma_{meca} = S \cdot f_0 \cdot (l + l_p)$$

where $f_0$ is the maximum bending of the strip 12.

Here, this bending $f_0$ is approximated by means of the following relationship:

$$f_0 \approx \frac{-d}{\frac{-l + (1 - \beta)x}{l + l_p} - 1} \quad (16)$$

The factor S of the relationship (15) is given by the following relationship:

$$S = \frac{E}{\frac{l^3}{3I_1} + \frac{(\beta x)^3}{3I_2} + \frac{e_x^3}{3I_3} + \frac{(\beta x)^3}{3I_4} + \frac{1}{I_1}(l^2 l_P + l(l_p)^2) + \frac{1}{I_3}((\beta x)^2 e_s + (\beta x)(e_x)^2)} \quad (17)$$

where the coefficients I1 and I2 are given by the following relationships:

$$I_1 = \frac{e_c \cdot e^3}{12} \quad (18)$$

$$I_2 = \frac{e_c e_p^3}{12} \quad (19)$$

The coefficients $I_3$ and $I_4$ have already been defined here above. On the basis of the previous relationships, the length l is calculated.

With the numerical data taken into account here, the results obtained are the following: I=40 μm, e=5 μm, $t_p$=30 μm and g=50 μm.

At a step 35, it is verified that a torque $\Gamma_0$ exerted by the magnetic forces in the open position when the field $B_0$ is present is strictly greater than the restoring torque $\Gamma_r$ for the mechanical forces. If this is the case, then it ensures that the micro-contactor 2 will shift to its closed position when the magnetic field $B_0$ is present. Different numerical simulations made by the present filing party have established a relationship which approximates a force $F_0$ exerted by the magnetic forces on the strip 12 in the open position. This relationship is the following:

$$F_0 = (36.790 + 2.310 \cdot e_p - 10.465 \cdot d + 0.54d^2 - 0.116 \cdot e_p \cdot d) \cdot \frac{e_c}{20} \quad (20)$$

On the basis of the force $F_0$, it is also possible to reduce the torque of the magnetic forces that is exerted on the end 20. This torque is given here by the following relationship:

$$\Gamma_0 = (36,790 + 2,310e_p - 10,465d + 0,54d^2 - 0,116e_p d)\frac{e_c}{20}(21 + l_P + (\beta - 1)x)10^{-12} \quad (21)$$

The previous two relationships (20) and (21) were established by using the same assumptions as for the relationship (1). Furthermore, in both these relationships, the thickness $e_p$, the distance d, the thickness $e_c$ are expressed in μm, the torque $\Gamma_0$ in N·m, the force $F_0$ is expressed in μN and the thickness $e_p$ ranges from 10 to 100 μm.

If the torque $\Gamma_0$ is not greater than the torque $\Gamma_r$, then a step 36 is performed during which the thickness $e_p$ is incremented or the thickness e is diminished. At the end of the step 36, there is a return to the step 34 so as to again calculate the length l and the depth $t_p$.

Should the torque $\Gamma_0$ be greater than the torque $\Gamma_r$, then, at a step 37, a check is made to see if the force $f_{amin}$ is truly greater than or equal to 20 μN. If the answer is negative, a step 38 is performed during which the distance g is modified. For example, the distance g is diminished. At the end of the step 38, the method returns to the step 34.

If the contrary is the case, the operation proceeds to a step 39 during which the micro-contactor 2 having determined dimensions is fabricated.

The micro-contactor having the dimensions given above occupies an approximate surface area of silicon of 650 μm (=2l+$l_p$+βx−x) by 85 μm (=2$e_p$+d) in addition to contact pad in the plane XY.

An example of the method for fabricating the micro-contactor 2 shall now be described in greater detail by means of the method shown in FIG. 5.

The fabrication method described is a collective or batch fabricating method using the technologies of fabrication methods of microelectronics. It therefore starts with the supply of a silicon wafer on which several micro-contactors 2 will be fabricated simultaneously by means of the same operations. To simplify the following description, the different fabricating steps are described solely in the case of a single micro-contactor. Different states of fabrication obtained during the method of FIG. 3 are shown in vertical section in FIGS. 6 to 10.

At a step 40, a layer 41 (FIG. 6) of photosensitive resin is deposited on the upper face 6 of the substrate 4. Then, the zones in which cavities have to be hollowed out in the substrate 4 are defined by insolation of the resin. These zones correspond to the location of the electrodes and of the strips. Here, this is a classic step of photolithography.

At a step 42, an anisotropic etching of the defined zones is carried out to etch cavities 44, 46 (FIG. 6) in the substrate, forming a hollow model for the strips 12 and 14 and the electrodes 8 and 10. The term "anisotropic" etching herein designates an etching whose etching speed in the direction Z is at least ten times and preferably fifty or a hundred times greater than the etching speed in the horizontal directions X and Y. In other words, the horizontal etching speed is negligible relatively to the etching speed in the vertical direction. This gives flanks that are more vertical than if the etching were to be done by means of other etching methods. In particular, the flanks of the cavities 44, 46 thus hollowed out are more vertical than they would be if they had been hollowed out in a photosensitive resin or by means of another etching method. For example, the method used here is a plasma etching or a deep silicon chemical etching.

At a step 48, the layer 41 of photosensitive resin is removed and the conductive coating 28 is deposited on the entire upper face. Thus, this conductive coating covers not only the vertical flanks of the cavities but also the bottom of the cavities as well as the upper face 6 of the substrate.

Figure 7:
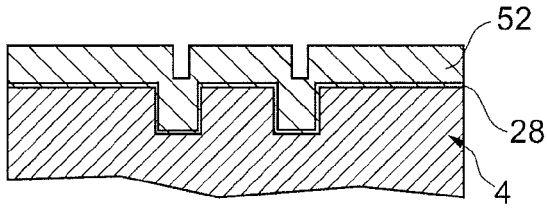
Figure 5:
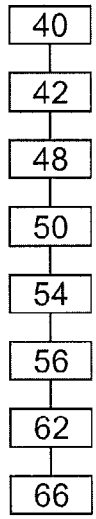
FIG. 5 is a flowchart of a method for fabricating the contactor of FIG. 1, FIGS. 6 to 10 are schematic illustrations in vertical section of a contactor of FIG. 1 in different states of fabrication.

At a step 50, the cavities are filled with a soft magnetic material 52 (FIG. 5). Here, the filling is done by electrolytic deposition by using the coating 28 as a conductive electrode. Thus, this coating 28 also fulfills the function of a seed layer. Since the coating 28 extends over the entire face of the substrate 4, the material 52 is also deposited on the entire upper face of the substrate 4 as well as inside the cavities 44 and 46. Thus, the state shown in FIG. 7 is obtained.

Figure 8:
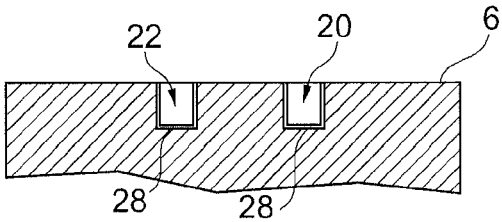
Figure 9:
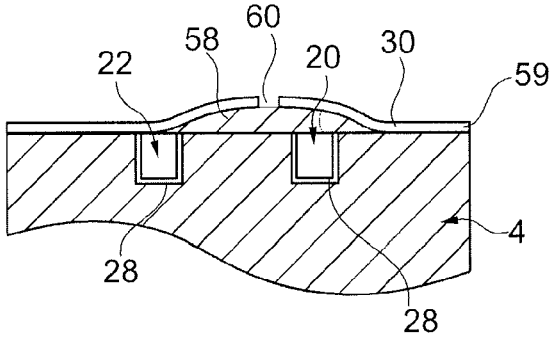

At a step 54, the mechanical/chemical planarization of the substrate 4 is performed to restore the plane upper face 6 of the substrate 4. Chemical mechanical planarization is also known by the acronym CMP. This planarization step is used herein to eliminate the material 52 and the coating 58 situated beneath the cavities 44 and 46. At the end of this step, the state shown in FIG. 8 is obtained.

At a step 56, the hood 30 is deposited at the location in which the well 24 is to be hollowed out. To this end, an excess thickness 58 (FIG. 9) of material is deposited above the zone in which the well 24 has to be hollowed out. The material used to create this excess thickness 58 is capable of being etched by the same isotropic etching agent as the substrate 4. For example, here, the material is silicon. This excess thickness 58 insulates the hood 30 from the upper face of the distal ends 20 and 22. Then, again in this step 56, a thin layer 59 is deposited on the entire upper face of the substrate 4. This thin layer 59 is made out of a material resistant to the isotropic etching agent. Finally, in this thin layer 59 forming the hood 30, intake holes 60 are made for the isotropic etching agent. To simplify FIG. 9, only one of the holes 60 has been shown. These holes are laid out above the location at which the well 24 has to be hollowed out.

At a step 62, the substrate 4 is etched directly to make the well 24. During this step, the etching done is isotropic. An isotropic etching is a step of etching in which the etching speeds in the directions X, Y are equal to the etching speed in the direction Z plus or minus 50% and preferably plus or minus 20 or 10%.

At the step 62, the isotropic etching agent is put into direct contact with the silicon to be etched through the intake holes 60. The etching agent used is chosen so as not to react with the soft magnetic material 52 and the coating 28. For example, the etching agent is a gas $XeF_2$.

Figure 10:
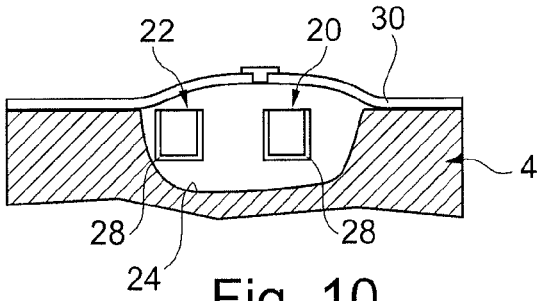

Since the etching agent is an isotropic etching agent, it clears the vertical faces of the ends 20 and 22 and, at the same time, the bottom, i.e. the lower face of the distal end 20 (FIG. 10).

Thus, at the end of this isotropic etching step, the well 24 is made.

Finally, at a step 66, the intake holes 60 are closed again if necessary and the wafer on which the different micro-contactors had been made in a batch is cut out to separate them mechanically from one another.

Figure 11:
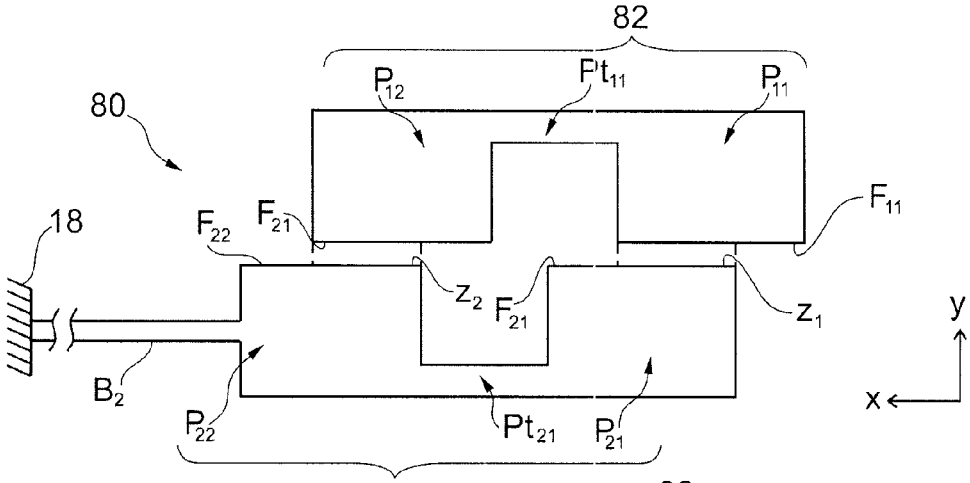
FIGS. 11 and 12 are schematic illustrations in a top view of two other possible embodiments for the ends of the contactor of FIG. 1.

FIG. 11 shows a micro-contactor 80. This micro-contactor 80 is identical to the micro-contactor 2 except that the end 20 is replaced by a fixed end 82. The end 82 is herein identical to the end 20 except that it is fixed without any degree of freedom to the substrate 4. The arm $B_1$ is therefore omitted.

The size of the pads $P_{21}$ and $P_{22}$ is identical to what was described with reference to FIG. 4 except that the bending $f_0$, the torque $\Gamma_{meca}$, the force $F_{amin}$ and the torque $\Gamma_{amin}$ are defined by the following relationships:

$$f_0=d \tag{22}$$

$$\Gamma_{meca}=\Gamma_r \tag{23}$$

$$F_{amin}=\frac{\Gamma_{amin}}{e_s+\beta x} \tag{24}$$

$$\Gamma_{amin}=S_{amin}\cdot d\cdot(e_s+\beta x)$$

As in the above embodiment, the pads $P_{11}$ and $P_{22}$ as well as the bridge $Pt_{11}$ are identical respectively to the pads $P_{21}$ and $P_{22}$ and to the bridge $Pt_{21}$.

Figure 12:
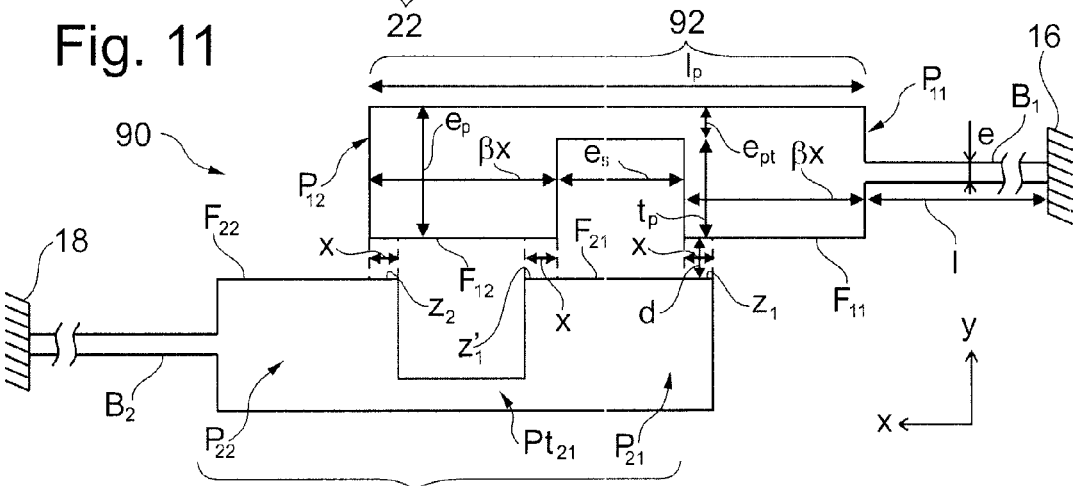

FIG. 12 shows a micro-contactor 90 identical to the micro-contactor 2 except that the end 20 is replaced by an end 92. To simplify this figure, only the ends 92 and 22 are shown in detail.

The end 92 is identical to the end 20 except that the distance g is chosen in this embodiment to be equal to −x to create a new overlap zone $Z'_1$ between the pads $P_{12}$ and the pad $P_{21}$. In addition, g is chosen so that the dimensions of this overlap zone $Z'_1$ are identical to those of the zones $Z_1$ and $Z_2$ so as to uniformly distribute the contact forces between the different contact points between the pads. Thus, in this embodiment, there are three contact points obtained with only two pairs of pads instead of two contact points as in the previous embodiment. The increase in the number of contact points makes it possible to reduce the resistance of the micro-contactor in the closed position since, as shall now be described with reference to FIG. 13, the ends 22 and 92 are sized so that the contact forces which are exerted at each contact point are identical to those that would be obtained if there were only one contact point.

Figure 4:
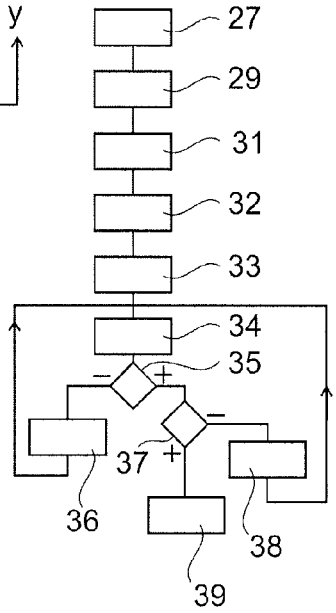
FIG. 4 is a flowchart of a method for sizing ends of the contactor of FIG. 1.
Figure 13:
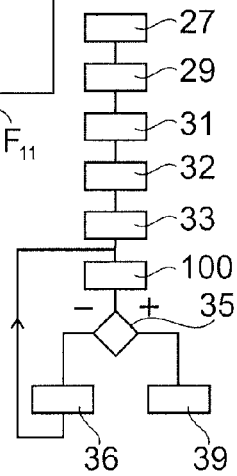
FIG. 13 is a flowchart of a method for sizing the ends of the embodiment of FIG. 12.

The method of sizing the micro-contactor 90 shown in FIG. 13 is identical to the one shown in FIG. 4 except that the step 34 is replaced by a step 100 and the steps 37 and 38 are omitted.

More specifically, at the step 100, the width $e_s$ of the groove is set by the following relationship:

$$e_s=\beta x-2x \tag{26}$$

Thus, only the length l, the thickness e and the depth $t_p$ are to be determined to obtain a restoring force $f_{rappel}$ and a force $f_{amin}$ equal to 20 μN.

As above, here the thickness e is chosen in order to restrict the space requirement of the micro-contactor 90. Here, e is chosen to be equal to 5 μm.

The thickness $t_p$ is determined from the constraint imposed on the force $f_{amin}$ in using the following relationships similarly to what was described here above with reference to the step 34.

The force $f_{amin}$ is given by the following relationship:

$$f_{amin}=\frac{2\Gamma_{amin}}{2e_s+\beta x} \tag{27}$$

$\Gamma_{amin}$ is the mechanical restoring torque exerted by the bridge $Pt_{11}$ on the pad $P_{12}$. It is given by the relationship (9). Thus, the constraint set on the force $f_{amin}$ enables the depth $t_p$ to be calculated from the above relationships.

Then, the length l is determined from the constraint laid down on the force $f_{rappel}$. However, unlike what was described in the step 34, the restoring force is given this time by the following relationship:

$$F_{rappel}=\frac{\Gamma r}{31+(6\beta-7/2)x} \tag{28}$$

As here above, the restoring force $\Gamma_r$ is given by the following relationship:

$$2\Gamma_{meca}=\Gamma_r \tag{29}$$

The torque $\Gamma_{meca}$ is given by the following relationship:

$$\Gamma_{meca}=S\cdot f_0\cdot(l+l_p) \tag{30}$$

In the preceding relationship, the length $l_p$ of the end 92 is given by the following relationship:

$$l_p=2\beta x+e_s \tag{31}$$

The factor S of the relationship (30) is determined from the same relationship (17) as that given with reference to the step 34.

With the same numerical examples as above, we obtain the following values. The length l is equal to 35 μm, the thickness e is equal to 5 μm and the depth $t_p$ is equal to 35 μm.

The total space requirement, apart from the contact pads, of the micro-contactor 90 is given by the product: total length $L_t$ multiplied by the total thickness $e_t$. The total length $L_t$ is given by the following relationship:

$$L_t=2l+l_p+(\beta-1)x \tag{32}$$

The thickness $e_t$ is given by the following relationship:

$$E_t=2e_p+d \tag{33}$$

Thus, the silicon surface area occupied by the strips is here 570×85 $\mu m^2$. The micro-contactor 90 therefore takes up slightly less space than the micro-contactor 2 and its resistance in the closed position is weaker.

Figure 14:
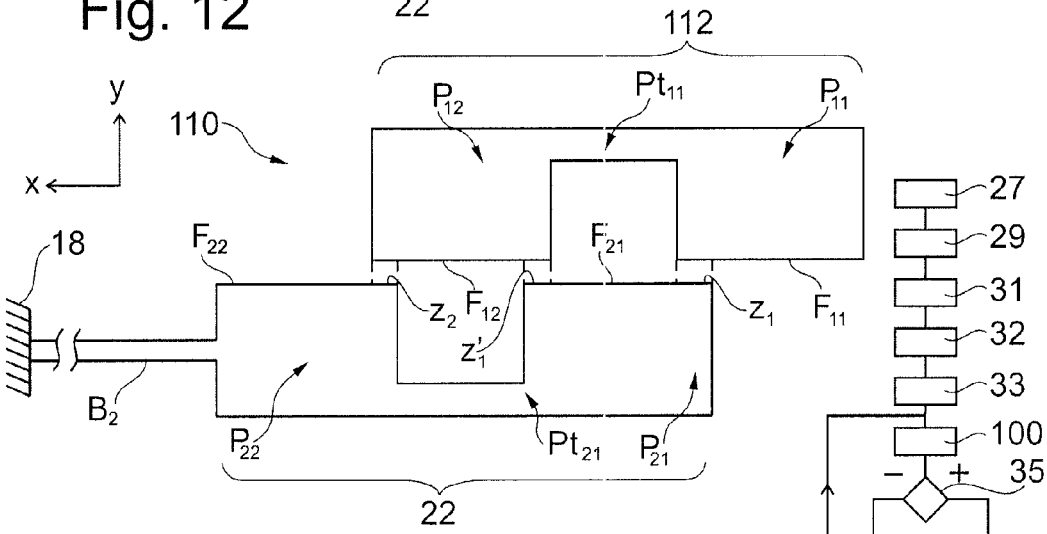
FIG. 14 is a schematic illustration in a top view of another possible embodiment of the ends of the contactor of FIG. 1.

FIG. 14 shows a micro-contactor 110 identical to the micro-contactor 90 but wherein the end 92 is replaced by a fixed end 112.

The end 112 is fixed without any degree of freedom to the substrate 4. The arm $B_1$ is omitted.

The sizing of the micro-contactor 110 is deduced from the description given with reference to FIG. 13. However, the following relationships are used instead of the corresponding relationships in FIG. 13.

$$f_0=d \tag{34}$$

$$\Gamma_{meca}=\Gamma_r \tag{35}$$

$$\Gamma_{meca}=S\cdot d\cdot(l+l_p) \tag{36}$$

$$F_{amin}=\frac{\Gamma_{amin}}{2e_s+\beta x} \tag{37}$$

$$\Gamma_{amin}=S_{amin}\cdot d\cdot(e_s+\beta x) \tag{38}$$

Numerous other embodiments are possible. For example, it is not necessary to lay down that the length x should be equal to half the thickness $e_p$ although this seems to make it possible to achieve an optimum between, on the one hand, the reduction of the resistance and, on the other hand, low space requirement or compactness. For example, as a variant, x is chosen so that it ranges from $e_p/3$ to $e_p/1.5$. Preferably, the length x is chosen to be equal to $e_p/2$ plus or minus 30%.

Other methods of sizing the ends of the strips are possible. In particular, it is possible, for one set of dimensions and using a simulation software, to simulate the working of the micro-contactor. If the constraints dictated on the simulated functioning of the micro-contactor are not satisfactory, the dimensions are modified and a new simulation is carried out. Thus, by successive trials, it becomes possible to determine the dimensions of the ends that meet the constraints imposed.

During the sizing of the ends of the strips, the constraints on the force $f_{amin}$ can be omitted.

To limit the transversal surface area of the bridge $P_{ij}$, it is also possible to limit its height in the vertical direction. In one particular case, only the height of the bridge $P_{ij}$ in the vertical direction is limited in order to satisfy the relationship $S_{Ptij} \leqq 2/3 S_{Zi}$.

The above description with regard to the forming of the ends can also be applied to the micro-contactor in which the strips shift perpendicularly to the plane of the substrate.

It is not necessary for the different contact forces at the different contact points to be all identical with one another. For example, at least one of the pads can be sized to produce a contact force greater than that produced by the other pads. For example, this can also be obtained by choosing different lengths for the different overlap zones.

In order that the micro-contactor may work properly, it is not necessary to saturate each of the pads magnetically. For example, only some pads are sized in order to be saturated by the field $B_0$. As a variant, none of the pads is saturated.

What has been described here in the particular case of micro-contactors can also be applied to contactors having macroscopic dimensions. These contactors with macroscopic dimensions are not fabricated by the same fabrication methods as those used in microelectronics. Furthermore, their dimensions are generally far greater. For example, the length of the strips often exceeds 1 or 3 mm.

The invention claimed is:

1. An apparatus comprising a contactor actuatable by a magnetic field, said contactor having at least one first strip and one second strip, each of which is made of a magnetic material and extends along a longitudinal direction, said first strip including a first pad P1*i* having a first contact face F1*i* parallel to said longitudinal direction, said second strip including a second pad P2*i* facing said first pad P1*i* and having a second contact face F2*i* parallel to said longitudinal direction, said first and second pads P1*i* and P2*i* facing each other when an intersection of said second contact face F2*i* and a projection in a transversal direction, perpendicular to said longitudinal direction, of said first contact face F1*i* on said second contact face F2*i* forms an overlap zone Zi, said overlap zone Zi having a surface area Szi greater than zero, at least one of said first and second pads P1*i*, P2*i* being capable of being shifted, in response to a magnetic field, along said transversal direction between a closed position and an open position, wherein, in said closed position, said first and second faces F1*i* and F2*i* are directly in mechanical contact with each other to enable passage of a current, and wherein, in said open position, said first and second faces F1*i* and F2*i* are separated from each other by an air gap so as to be electrically insulated from each other, wherein said at least one first strip and said at least one second strip include pads forming a plurality of pairs of pads P1*i*, P2*i* facing each other, said pairs being disposed consecutively along said longitudinal direction, and wherein each of said at least one first strip and at least one second strip includes at least one bridge Ptji, said at least one bridge mechanically and directly linking two pads Pji, Pj,i+1 that are immediately consecutive along said strip, a cross-section of said bridge Ptji being reduced relative to a cross-section of said pads Pji, Pj,i+1, and a surface area SPtji of a smallest cross-section of said bridge Ptji satisfying a relationship 0<SPtji<2/3Szi, where j is an index identifying said strip and i is an index identifying said pad on said strip.

2. The apparatus of claim 1, wherein said surface area Szi of each overlap zone satisfies 0<Szi≦S1*i*/3 and 0<Szi≦S2*i*/3, where Sij is a surface area of a corresponding contact face Fij.

3. The apparatus of claim 1, wherein each pad Pji is a parallelepiped extending in parallel to said longitudinal direction, said parallelepiped having a thickness epji in said transversal direction and wherein said overlap zone is a rectangular overlap zone having a length x in said longitudinal direction, said length x being equal to epji/2 plus or minus 30%.

4. The apparatus of claim 1, wherein at least one of said pads Pji faces said pad P2*i* and said pad P2,*i*+1.

5. The apparatus of claim 1, wherein said surface areas Szi of said overlap zones are equal and said dimensions of said pads Pij are equal.

6. The apparatus of claim 1, wherein said contactor comprises a planar substrate having a well hollowed out therein, and said strips are entirely disposed within said well.

7. The apparatus of claim 1, wherein each bridge Ptji corresponds to a bottom of a groove, said groove opening towards said air gap.

8. The apparatus of claim 1, further comprising a switch, said switch including said contactor, and a source of a first magnetic induction B0 parallel to said longitudinal direction for causing said pads to shift between said open position and said closed position, wherein said pads are dimensioned such that said first magnetic induction B0 saturates said pads P1*i* and P2*i* whereas a second magnetic induction B1 does not saturate said pads P1*i* and P2*i*, said second magnetic induction B1 having a direction identical to said first magnetic induction B0 and having an intensity equal to 80% of an intensity of said first magnetic induction B0.

9. The apparatus of claim 1, wherein said first and second contact faces are perpendicular to said transversal direction.

10. An apparatus comprising a contactor actuatable by a magnetic field, said contactor having at least one first strip and one second strip, each of which is made of a magnetic material and extends along a longitudinal direction, said first strip including a first pad P1*i* having a first contact face F1*i*, said second strip including a second pad P2*i* facing said first pad P1*i* and having a second contact face F2*i*, said first and second pads P1*i* and P2*i* facing each other when an intersection of said second contact face F2*i* and a projection in a transversal direction, perpendicular to said longitudinal direction, of said first contact face F1*i* on said second contact face F2*i* forms an overlap zone Zi, said overlap zone Zi having a surface area Szi greater than zero, at least one of said first and second pads P1*i*, P2*i* being capable of being shifted, in response to a magnetic field, along said transversal direction between a closed position and an open position, wherein, in said closed position, said first and second faces F1*i* and F2*i* are directly in mechanical contact with each other to enable passage of a current, and wherein, in said open position, said first and second faces F1*i* and F2*i* are separated from each other by an air gap so as to be electrically insulated from each other, wherein said at least one first strip and said at least one second strip include pads forming a plurality of pairs of pads P1*i*, P2*i* facing each other, said pairs being disposed consecutively along said longitudinal direction, and wherein each of said at least one first strip and at least one second strip includes at least one bridge Ptji, said at least one bridge mechanically and directly linking two pads Pji, Pj,i+1 that are immediately consecutive along said strip, a cross-section of said bridge Ptji being reduced relative to a cross-section of said pads Pji, Pj,i+1, and a surface area SPiji of a smallest cross-section of said bridge Ptji satisfying a relationship $0<SPtji<\frac{2}{3}Szi$, where j is an index identifying said strip and i is an index identifying said pad on said strip, wherein each pad Pji is a parallelepiped extending in parallel to said longitudinal direction, said parallelepiped having a thickness epji in said transversal direction and wherein said overlap zone is a rectangular overlap zone having a length x in said longitudinal direction, said length x being equal to epji/2 plus or minus 30%.

11. An apparatus comprising a contactor actuatable by a magnetic field, said contactor having at least one first strip and one second strip, each of which is made of a magnetic material and extends along a longitudinal direction, said first strip including a first pad P1*i* having a first contact face F1*i*, said second strip including a second pad P2*i* facing said first pad P1*i* and having a second contact face F2*i*, said first and second pads P1*i* and P2*i* facing each other when an intersection of said second contact face F2*i* and a projection in a transversal direction, perpendicular to said longitudinal direction, of said first contact face F1*i* on said second contact face F2*i* forms an overlap zone Zi, said overlap zone Zi having a surface area Szi greater than zero, at least one of said first and second pads P1*i*, P2*i* being capable of being shifted, in response to a magnetic field, along said transversal direction between a closed position and an open position, wherein, in said closed position, said first and second faces F1*i* and F2*i* are directly in mechanical contact with each other to enable passage of a current, and wherein, in said open position, said first and second faces F1*i* and F2*i* are separated from each other by an air gap so as to be electrically insulated from each other, wherein said at least one first strip and said at least one second strip include pads forming a plurality of pairs of pads P1*i*, P2*i* facing each other, said pairs being disposed consecutively along said longitudinal direction, and wherein each of said at least one first strip and at least one second strip includes at least one bridge Ptji, said at least one bridge mechanically and directly linking two pads Pji, Pj,i+1 that are immediately consecutive along said strip, a cross-section of said bridge Ptji being reduced relative to a cross-section of said pads Pji, Pj,i+1, and a surface area SPiji of a smallest cross-section of said bridge Ptji satisfying a relationship $0<SPtji<\frac{2}{3}Szi$, where j is an index identifying said strip and i is an index identifying said pad on said strip, further comprising a switch, said switch including said contactor, and a source of a first magnetic induction B0 parallel to said longitudinal direction for causing said pads to shift between said open position and said closed position, wherein said pads are dimensioned such that said first magnetic induction B0 saturates said pads P1*i* and P2*i* whereas a second magnetic induction B1 does not saturate said pads P1*i* and P2*i*, said second magnetic induction B1 having a direction identical to said first magnetic induction B0 and having an intensity equal to 80% of an intensity of said first magnetic induction B0.

* * * * *